US005906564A

United States Patent [19]

Jacobsen

[11] Patent Number: 5,906,564

[45] Date of Patent: May 25, 1999

[54] ADJUSTABLE INCLINE TRAVELING PLATFORM EXERCISE APPARATUS

[75] Inventor: Neill Jacobsen, 3100 Sweetwater Rd., Lawrenceville, Ga. 30044

[73] Assignee: Neill Jacobsen, Lawerenceville, Ga.

[21] Appl. No.: 09/017,102

[22] Filed: Jan. 31, 1998

[51] Int. Cl.[6] ..... A63B 21/068

[52] U.S. Cl. ..... 482/96; 482/135; 482/137; 482/140; 482/142

[58] Field of Search ..... 482/95, 96, 132, 482/134, 135, 136, 138, 142, 140

[56] References Cited

U.S. PATENT DOCUMENTS

| | | | |
|---|---|---|---|
| 2,733,922 | 2/1956 | Diego | 482/96 |
| 4,383,684 | 5/1983 | Schliep | 482/96 |
| 4,468,025 | 8/1984 | Sferle | 482/96 |
| 4,911,438 | 3/1990 | Van Straaten | 482/96 |
| 5,354,251 | 10/1994 | Sleamaker | 482/96 |
| 5,492,518 | 2/1996 | Measom | 482/96 |
| 5,733,229 | 3/1998 | Dalebout et al. | 482/96 |
| 5,810,698 | 9/1998 | Hullett et al. | 482/96 |

*Primary Examiner*—Richard J. Apley
*Assistant Examiner*—Victor K. Hwang

[57] ABSTRACT

An exercise apparatus utilizing a wheeled rolling platform which moves on an incline frame and includes an adjustable arm cord mounting assembly. The arm cord mounting system includes a pair of elongated arm cords each entrained over a fixed pulley mounted in each adjustable upright corner post. An anchoring device attaches the cords to the mobile platform. The platform moves on the frame against a resistance force provided by the body weight of the user seated or lying on the platform and the upward angled slope of the incline frame. A back and head support connects the platform.

13 Claims, 19 Drawing Sheets

ADJUSTABLE INCLINE TRAVELING PLATFORM EXERCISE APPARATUS

BACKGROUND OF THE INVENTION

1. Field of the Invention

The present invention relates to a novel and useful exercise apparatus and relates to human body training concern with training the muscle of the "core", of the body which primarily helps to stabilize the body during a normal activities such as moving, standing and sitting.

Many exercise apparatuses have been proposed to rehabilitate or develop different muscles of the body. In addition, exercise apparatuses have used resistance devices such as weights and springs against which the user pushes or pulls, using the arms or legs. Unfortunately many apparatuses are not susceptible to use by persons of different heights or physical abilities.

The traditional prior art bench like the Pilates type bench has been a useful device for muscle training but limit its utility and render it less than an optimum tool for practicing total body training.

Consequently, a need exists for improvement of the traditional prior art in order to enhance its overall utility.

An exercise apparatus using a incline frame and a wheeled platform which are adjustable to accommodate person of different heights and weights would be a notable advance in the physical conditioning of a large and various groups of muscles for total body training, conditioning and also physical therapy field.

SUMMARY OF THE INVENTION

In accordance with the present invention a novel and enhanced exercise apparatus is herein provided to satisfy the aforementioned needs.

The exercise apparatus of the present invention utilizes a wheeled platform which is movable on a frame against a resistance force. The frame may provide a pair of rails and the platform may include wheels to ride on such rails. The resistance force may be provided by the user body weight. Cords extended through a pulley system mounted to the platform and at the far end to a pair of post, to handles which are gripped by the user.

The apparatus of the present invention also includes two identical back supports connected to each end of the mobile platform.

The two identical back supports can be also used as a leg device and for abdominal muscle conditioning.

It may be apparent that a novel and useful exercise apparatus has been described. It is therefore an object of the present invention to provide an exercise apparatus which utilizes a wheeled platform and requires the user to pull the platform upwards on a incline slope.

Another object of the present invention is to provide an exercise apparatus using wheeled platform moveable against a resistance force which is adjustable through the change of the slope angle and the users weight, for users of different height, weight and physical abilities, while the user is seating or lying on the platform.

Yet another object of the present invention is to provide an exercise apparatus which is compact and easy to assemble and use.

A further object of the present invention is to provide an exercise apparatus which employs a wheeled rolling platform and a multiplicity of supports permitting the use of the exercise apparatus in various conditioning and therapeutic situations.

Yet another object of the present invention is to provide an exercise apparatus which provides a wheeled rolling platform permitting the use of the legs for the conditioning of the legs major muscle groups.

The invention possesses other objects and advantages especially as concerns particular characteristics and features thereof which will become apparent as the specification continues.

Figure 1:
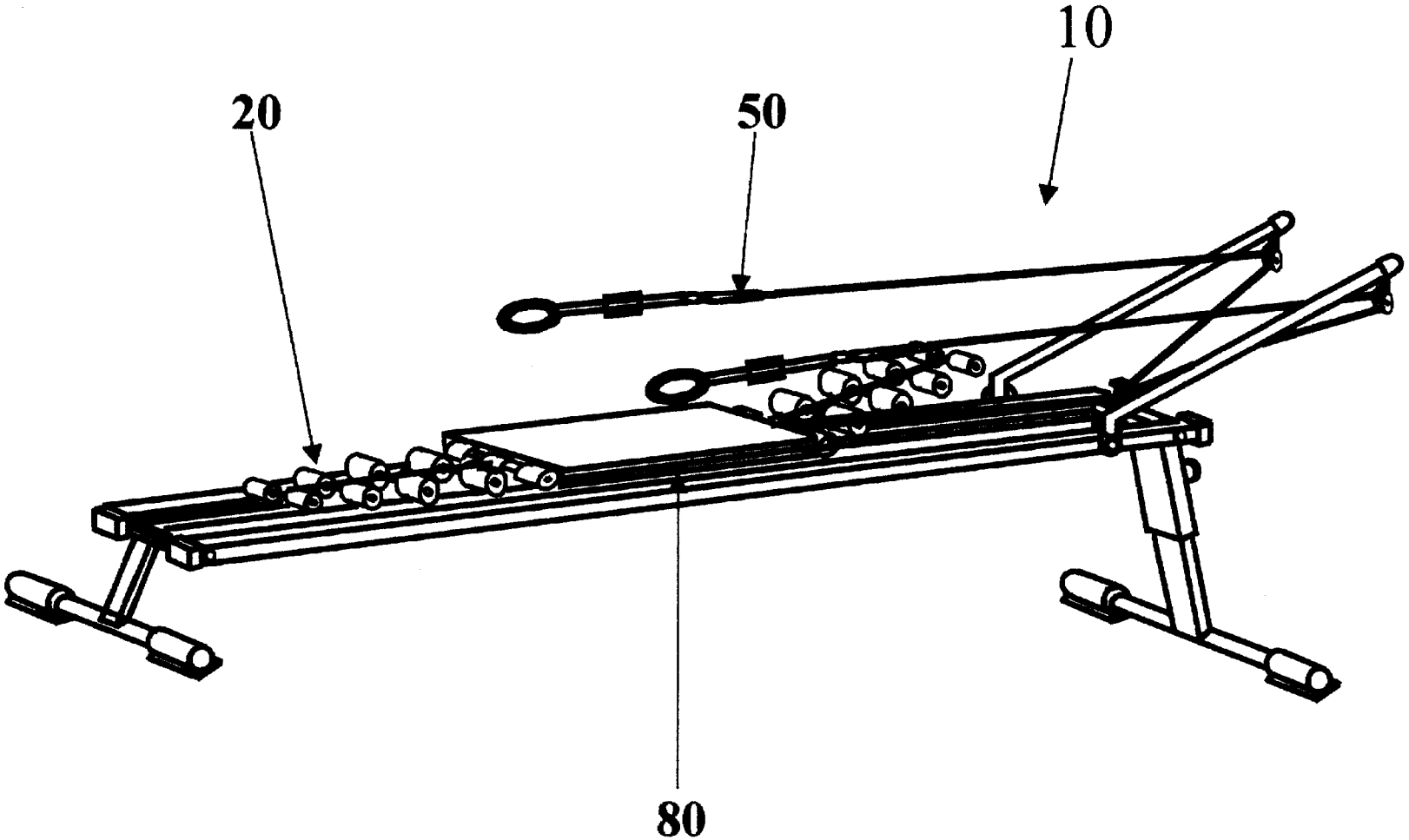
FIG. 1 is a top right, perspective view of an embodiment of the apparatus of the present invention.
Figure 2:
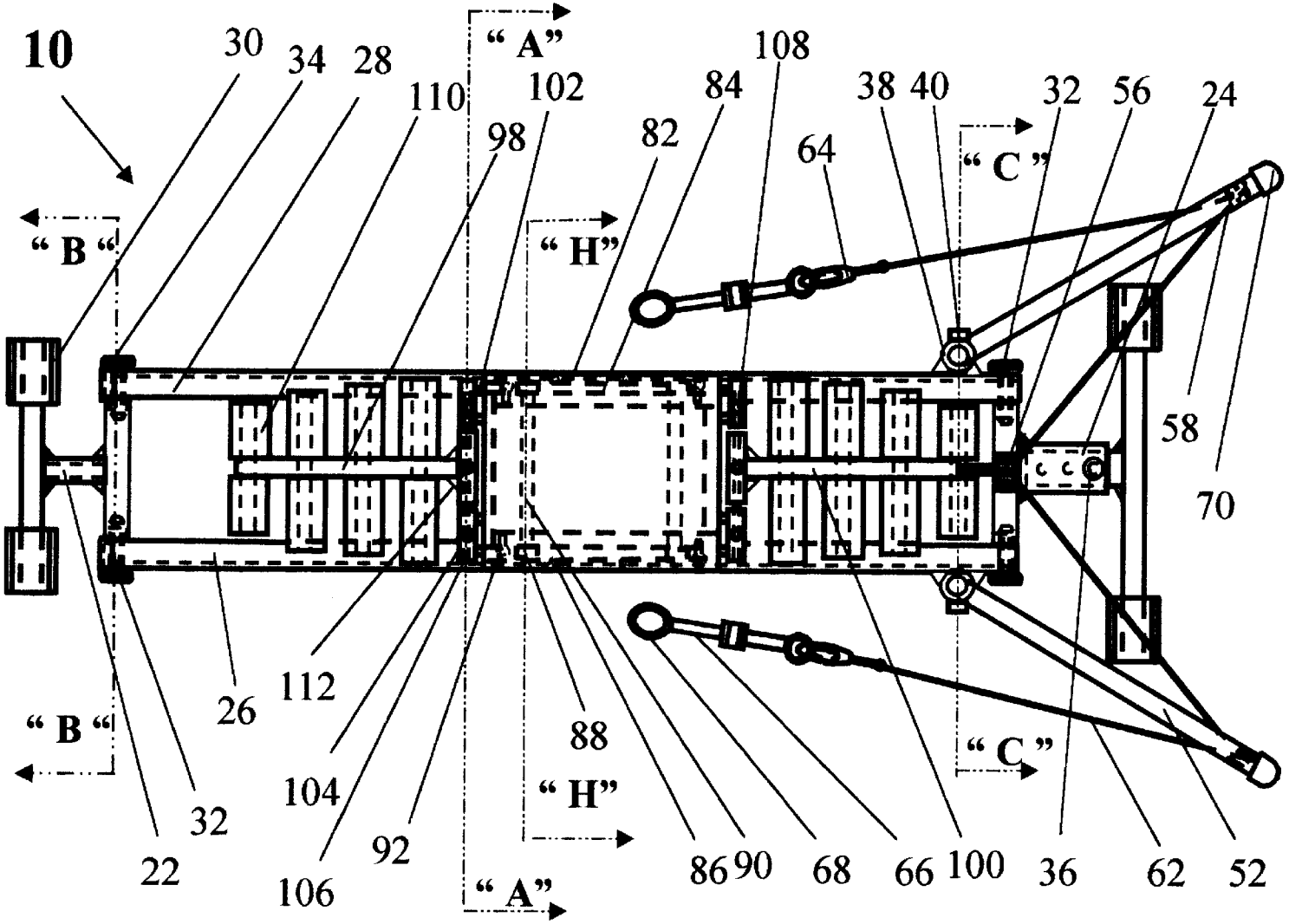
FIG. 2 is a top view of an embodiment of the apparatus of the present invention.
Figure 3:
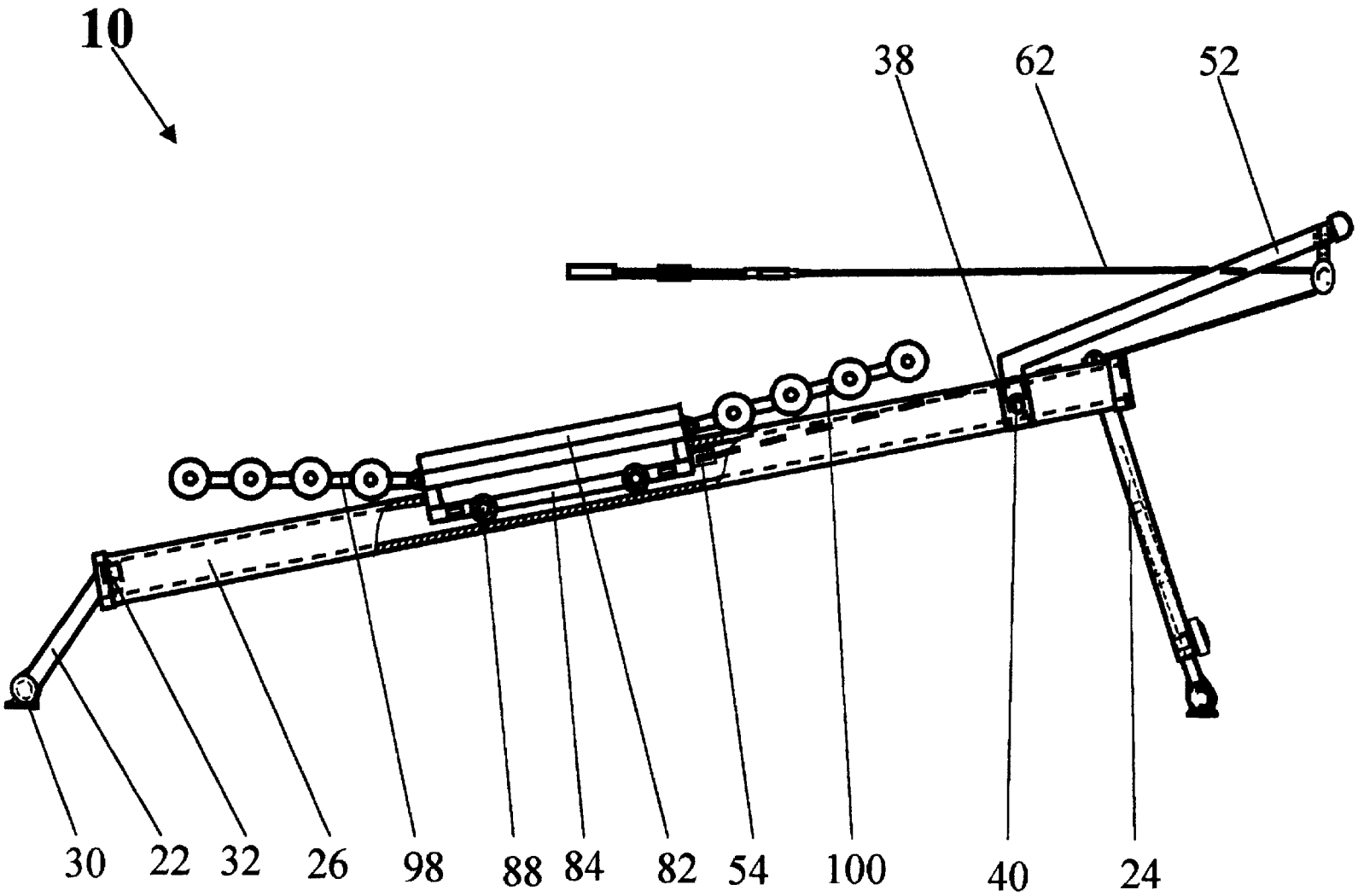
FIG. 3 is a side view of an embodiment of the apparatus of the present invention.

For a better understanding of the invention reference is made to the following detailed description of the preferred embodiments thereof which should be referenced to the prior described drawings.

These and other features and advantages of the present invention will become apparent to those skilled in the art upon a reading of the following detailed description when taken in conjunction with the drawings wherein there in shown and described an illustrative embodiment of the invention.

DESCRIPTION OF THE PREFERRED EMBODIMENTS

Various aspects of the present invention will evolve from the following detailed description of the preferred embodiments thereof which should be referenced to the herein above described drawings.

In the following description, like reference characters designate like or corresponding parts throughout the several views of the drawings. Also in the following description, it is to be understood that such terms as "front", "rear", "upper", "lower", "left", "right", and the like, are words of convenience and are not to be construed as limiting terms.

In General

Referring to the drawings, and particularly to FIGS. 1–9 there is shown an enhanced core movement training apparatus, generally designated 10, incorporating all improved futures of the present invention.

The apparatus as a whole is depicted in the drawings by reference character 10 and upper case letter to denote multiple embodiments.

Apparatus 10 incorporates three major embodiments (as viewed in FIG. 1).

Figure 4:
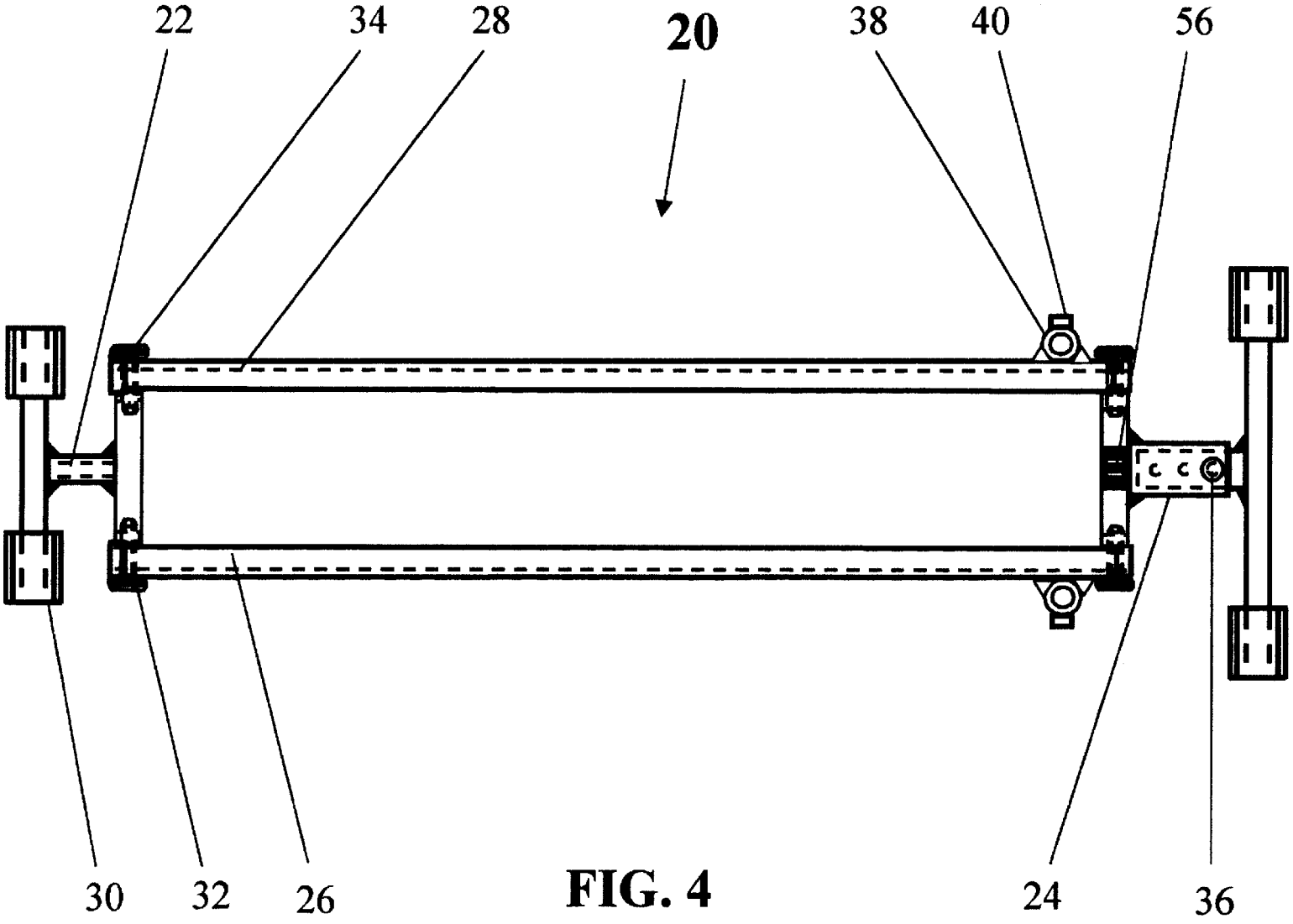
FIG. 4 is a top view of the main frame assembly 20 of the apparatus of the present invention.
Figure 5:
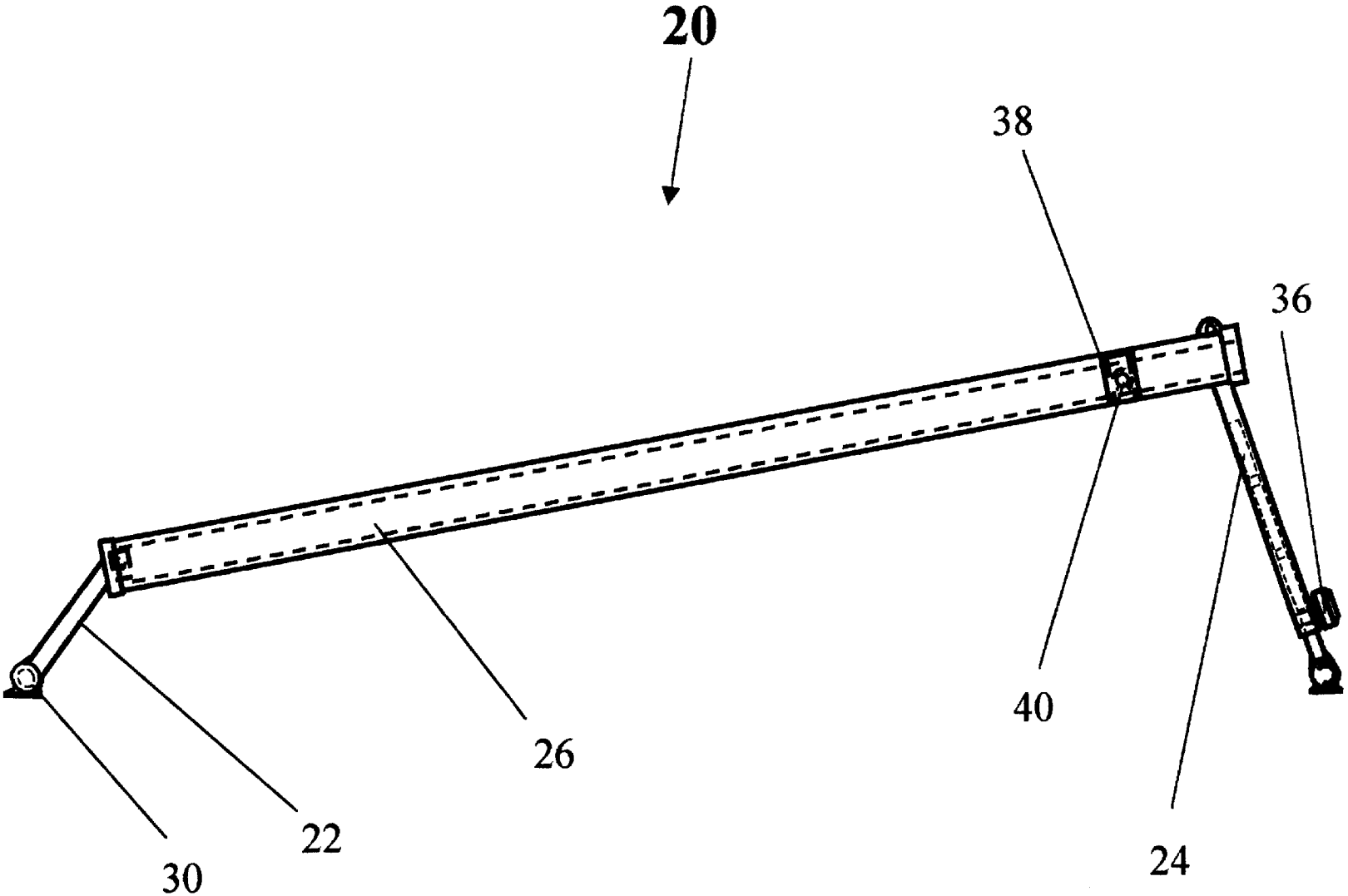
FIG. 5 is a side view of the main frame 20 depicted in FIG.4.
Figure 6:
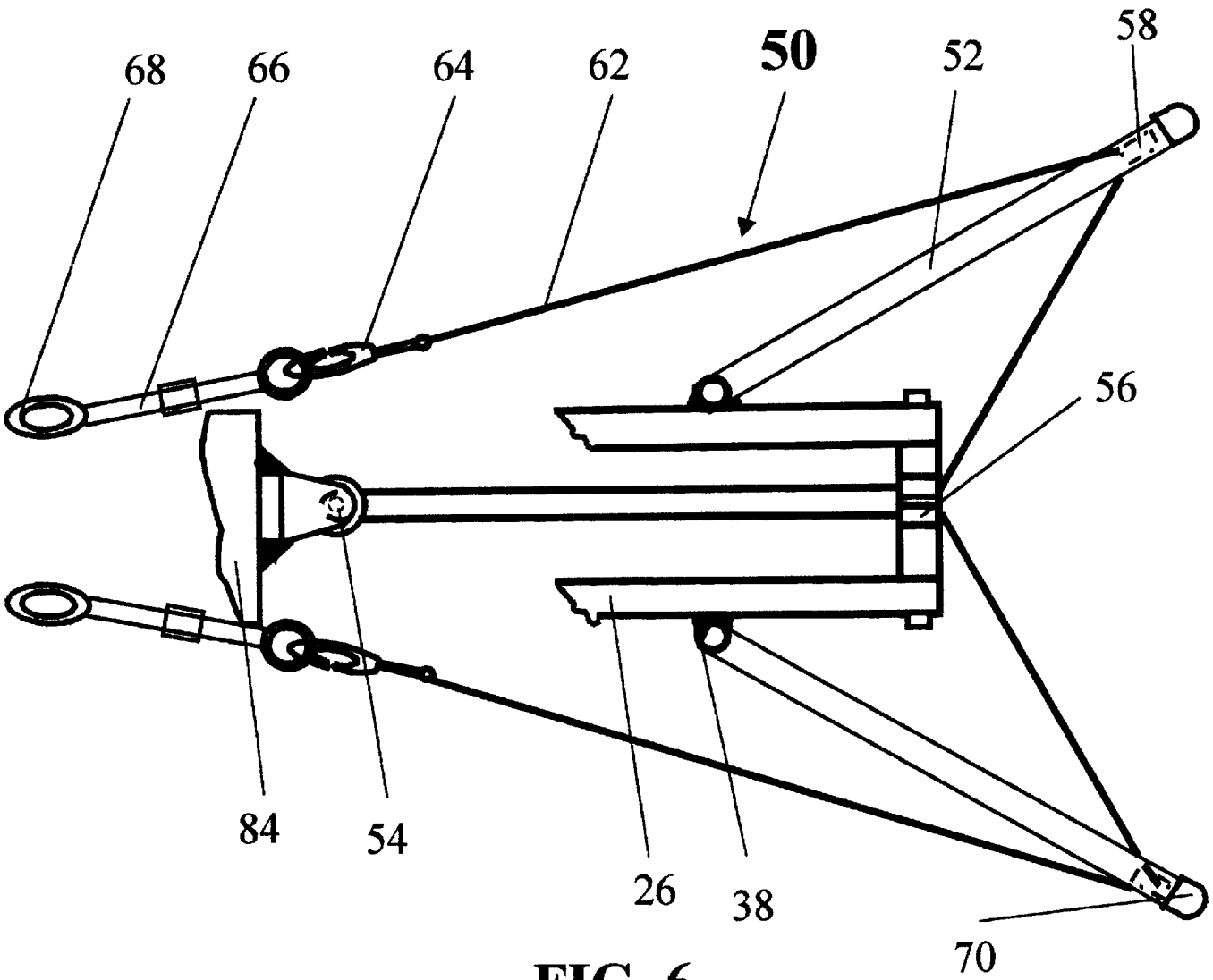
FIG. 6 is a top view of the pulley assembly 50 of the apparatus of the present invention.
Figure 7:
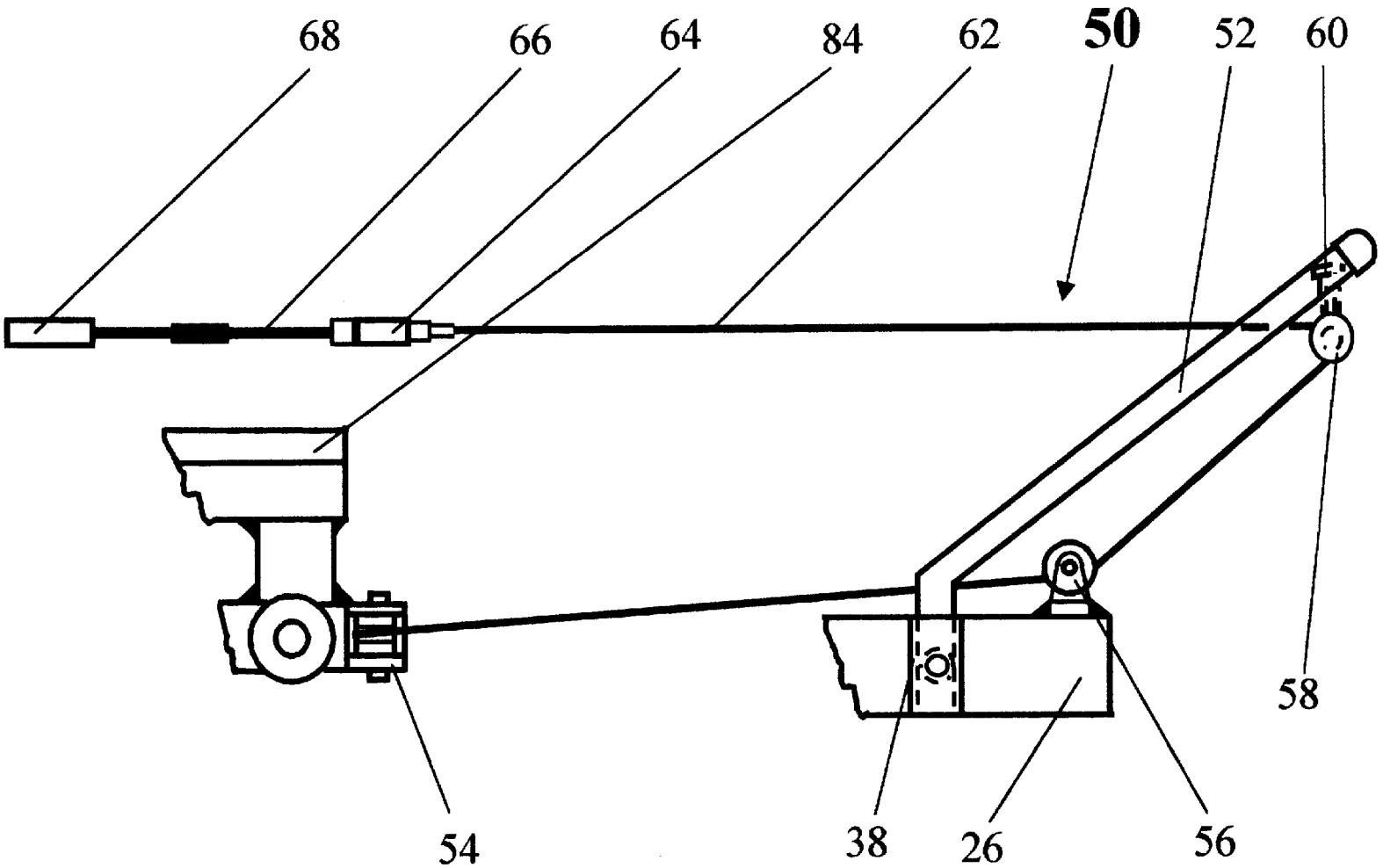
FIG. 7 is a side view of the pulley assembly 50 depicted in FIG. 6.
Figure 11:
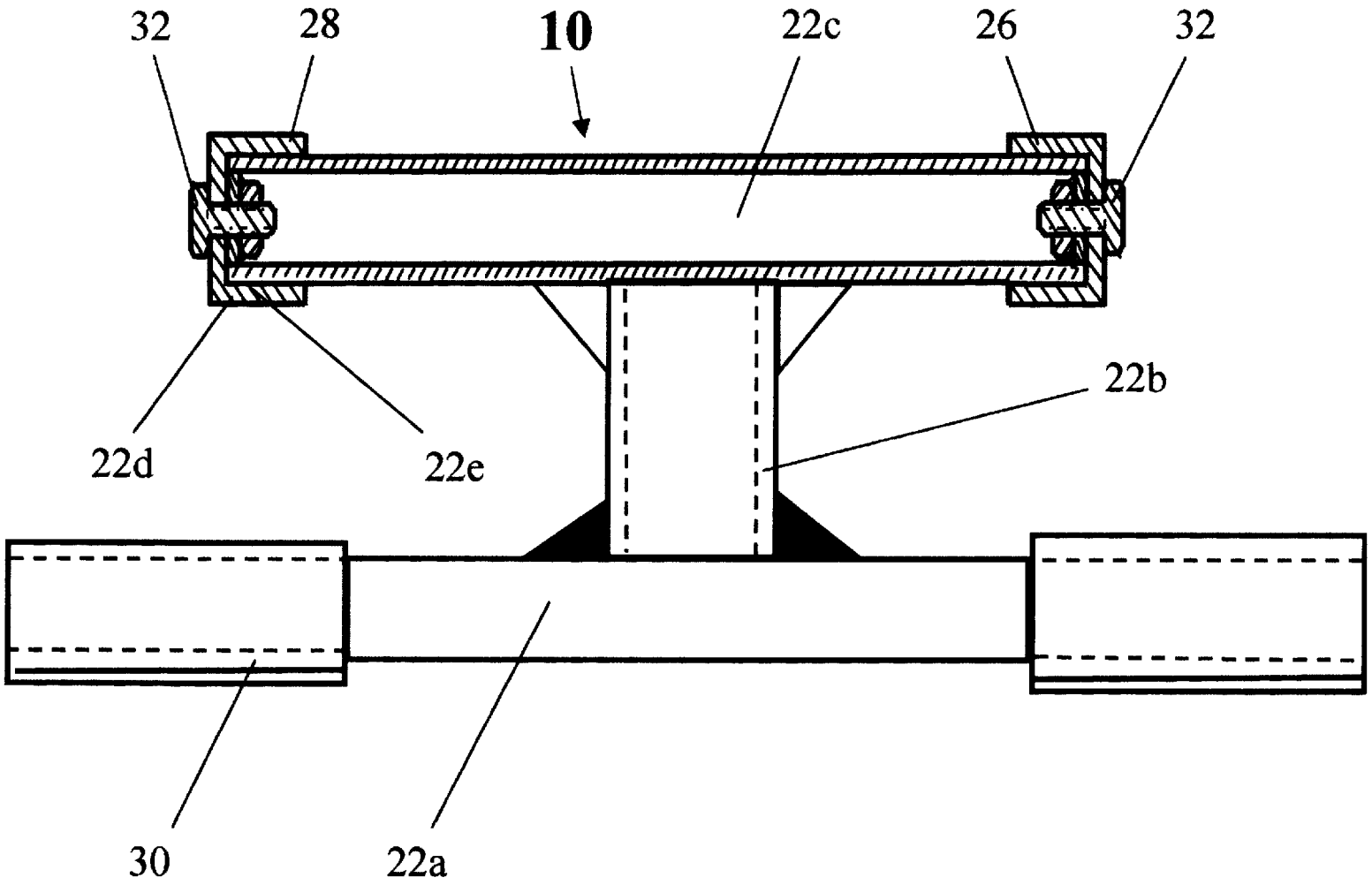
FIG. 11 is a sectional view "B—B" of the apparatus 10 depicted in FIG. 2.

The first major embodiment is the "Main frame" 20 which includes two "U" shape rails 26 and 28 connected to leg 22 and to adjustable leg 24 by a set of detachable fasteners 32 (as viewed in FIGS. 4 & 11).

The "U" shape rails 26 and 28 are made from extruded structural grade aluminum. Rails 26 and 28 have affixed at each end a set of protective plastic cap 34. Leg 22 includes a round horizontal base tubing 22*a,* a vertical rectangular tubing 22*b,* a horizontal top rectangular tubing 22*c,* a end plate 22*d* and a threaded nut 22*e* interconnected by welding (as viewed in FIG. 11).

Figure 12:
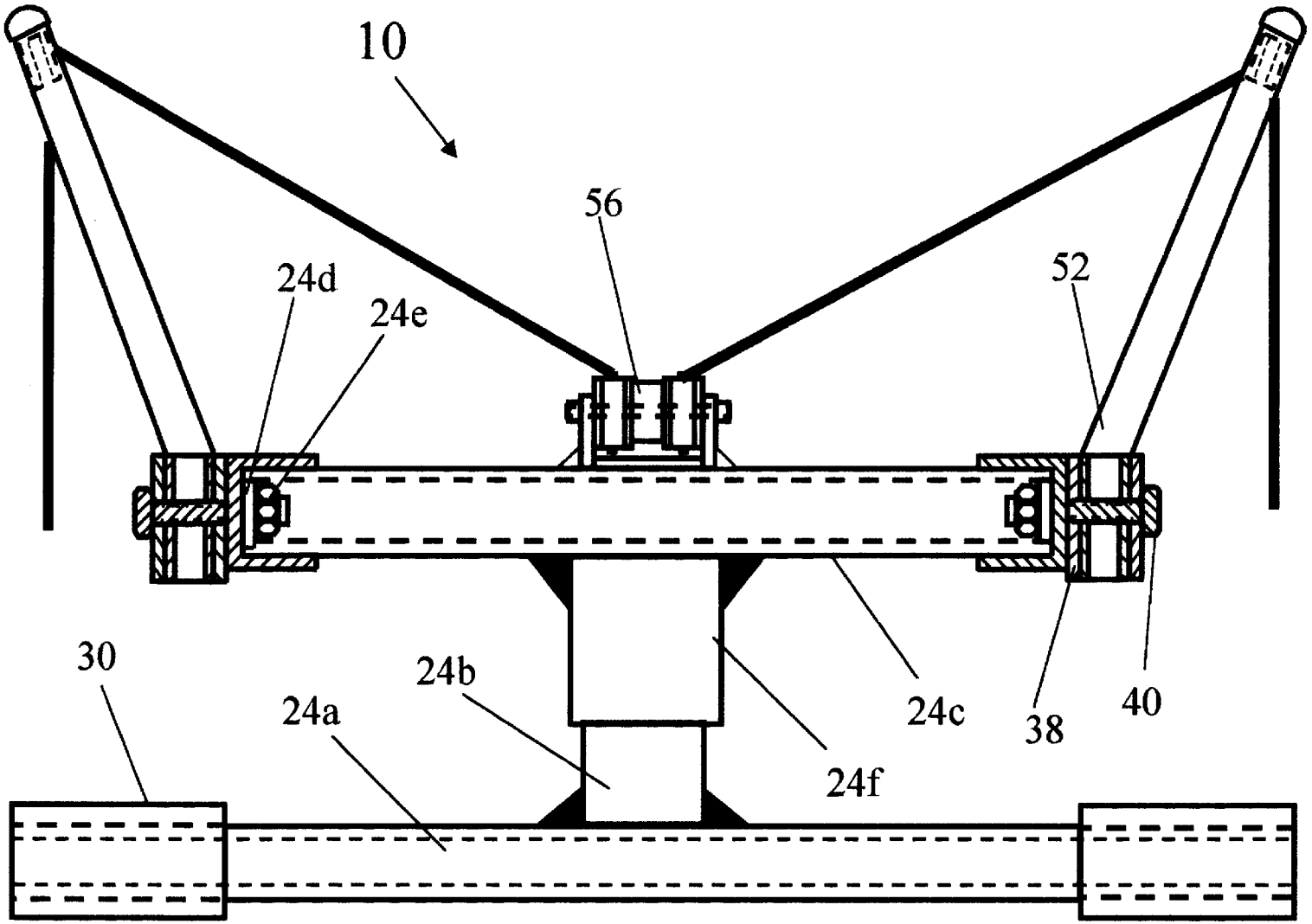
FIG. 12 is a sectional view "C—C" of the apparatus 10 depicted in FIG. 2.

The adjustable leg 24 has a lower leg member which includes a round horizontal base tubing 24*a* and a vertical rectangular tubing 24*b* interconnected by welding. Further the adjustable leg 24 has an upper leg member which includes a vertical rectangular tubing 24*f,* a horizontal top rectangular tubing 24*c,* an end plate 24*d* and a threaded nut 24*e* interconnected by welding (as viewed in FIG. 12).

The lower and higher members of leg 24 are connected by a detachable threaded knob 36. The legs 22 and 24 are made from structural grade aluminum and are supported by a set of detachable plastic leg base 30.

At the end near to the adjustable leg 24 there are connected by welding two post sleeves 38 and a pair of detachable threaded knobs 40 (as viewed in FIG. 4).

The second major embodiment of the apparatus 10 is the "Pulleys Assembly" 50 (as viewed in FIGS. 5, 6 & 12)which includes a pair of posts 52 mounted into sleeves 38 by a pair of detachable threaded knobs 40.

Figure 15:
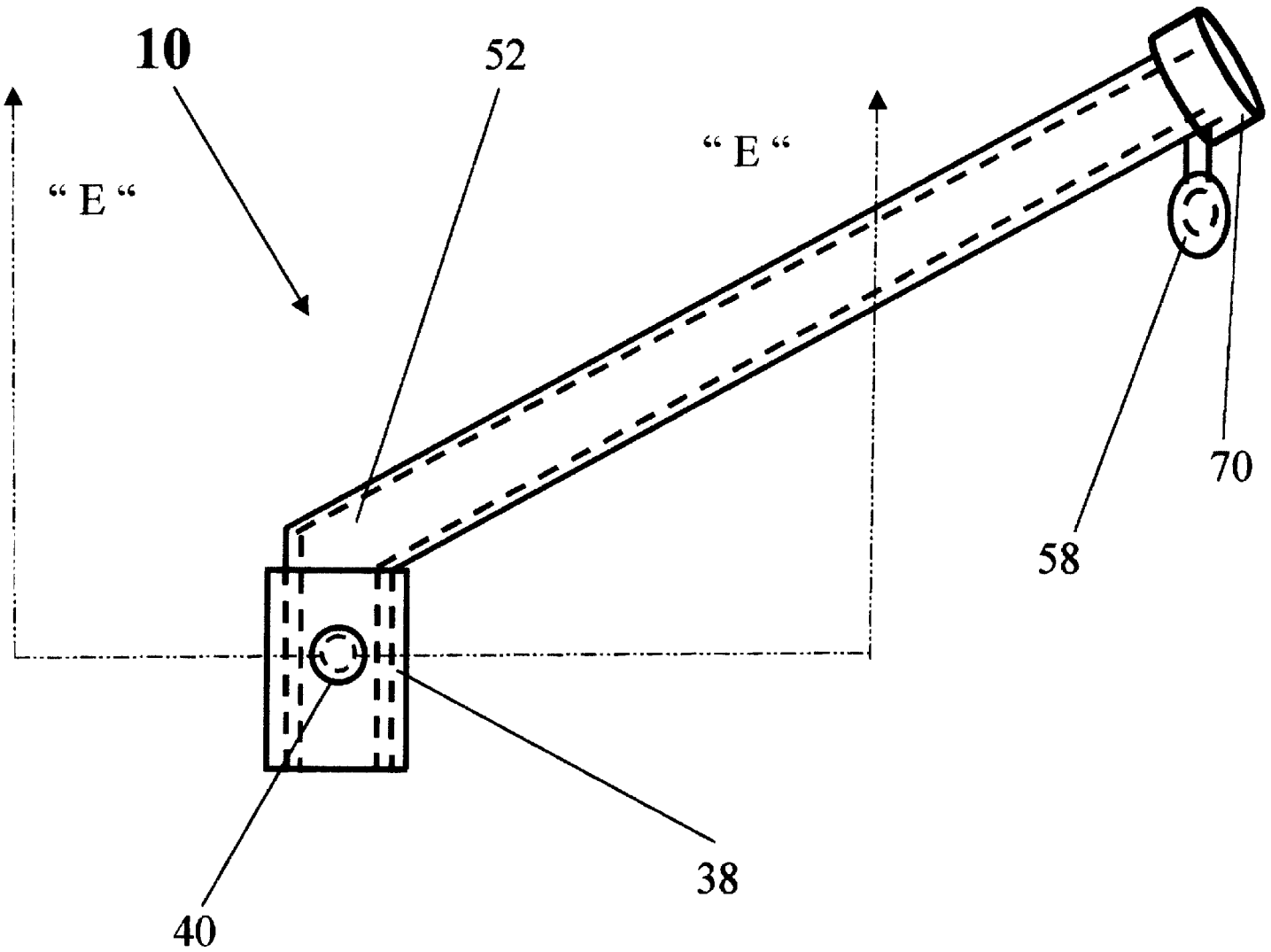
FIG. 15 is a side view of the post 52 and sleeve 38 assembly.
Figure 16:
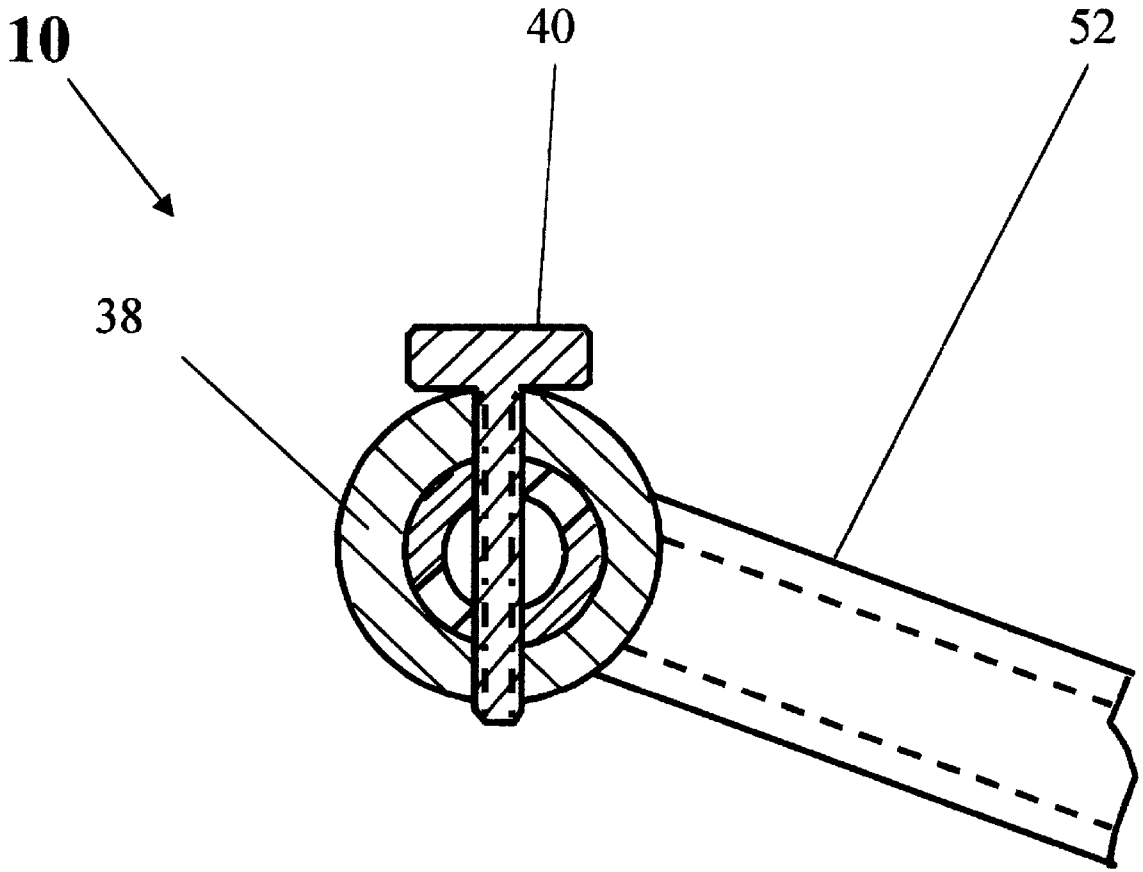
FIG. 16 is a sectional view "E—E" of the apparatus depicted in FIG. 15.

The post sleeves 38 and the post 52 are made from structural grade aluminum. The pair of posts 52 have a pair of plastic protective caps 70 mounted at each end. The posts 52 can rotate 360 degrees and can be locked at a desired angle by a knob 40 (as viewed in FIGS. 15 & 16).

The pulley assembly includes a single horizontal pulley 54 connected by welding to the undercarriage frame 84, a double vertical pulley 56 connected by welding on top of adjustable leg 24, and a pair of single vertical pulleys 58 mounted to the pair of posts 52 by a set of detachable fasteners 60.

Further the pulley assembly includes a cord 62 which it is entrained over a fixed horizontal pulley 54 mounted to the mobile carriage 80, further both ends of the cord 62 are extended through a fixed vertical double pulley 56 mounted on top of adjustable leg and extended through a pair of fixed vertical pulley 58 mounted in each adjustable upright corner posts 52.

Each end of the cord 62 is connected to the pair of cord hooks 64 which are connected to the pair of straps 66, which are further connected to the pair of handles 68. By way of example the cord 62 can be yacht braid cord. The handles 68 can be wood rings used in gymnastics, and the straps 64 can be fabricated from industrial grade nylon. The pulleys 54, 56 and 58 can be Harken pulleys.

Figure 8:
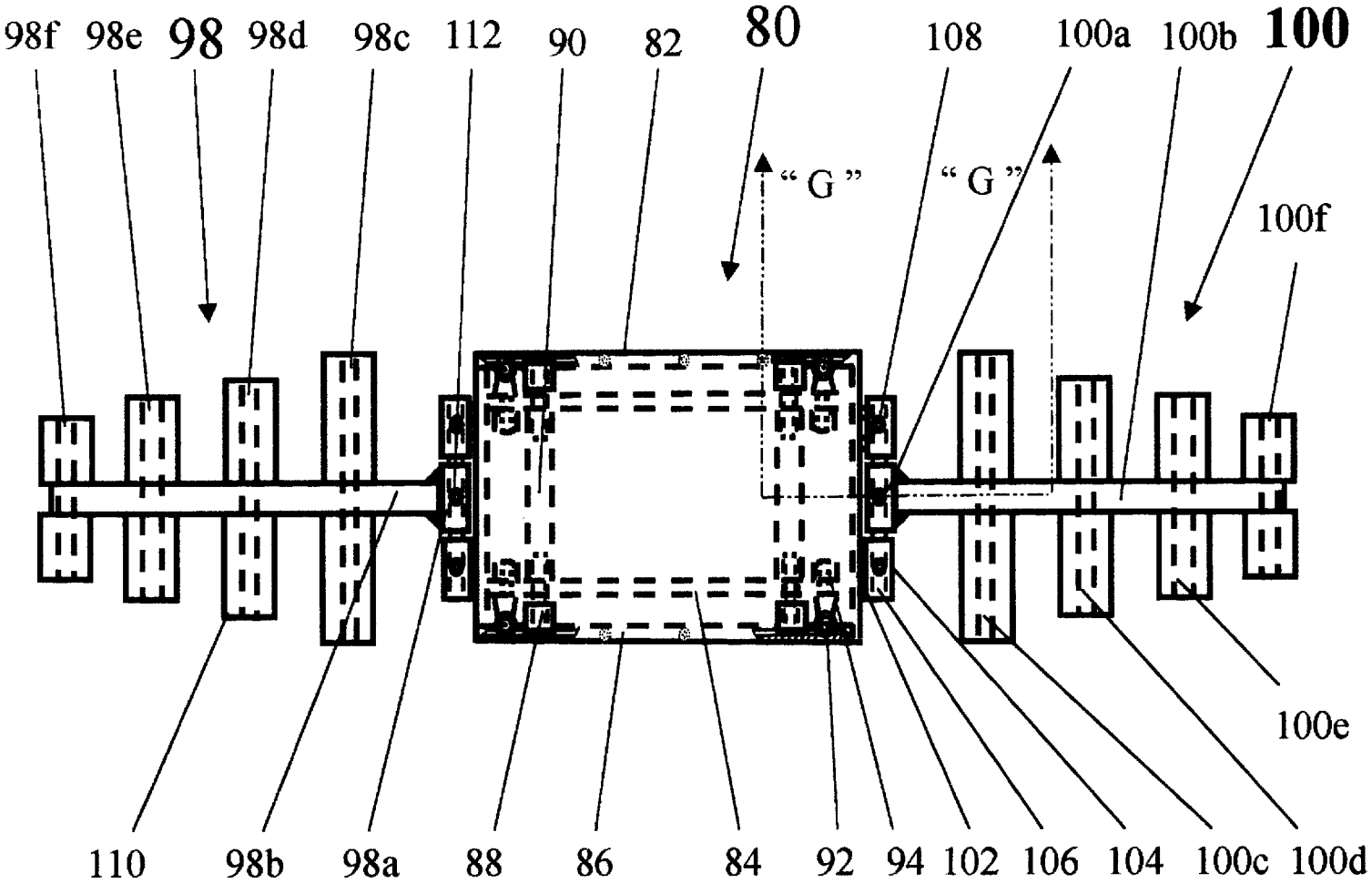
FIG. 8 is a top view of the mobile carriage 80 of the apparatus of the present invention.
Figure 9:
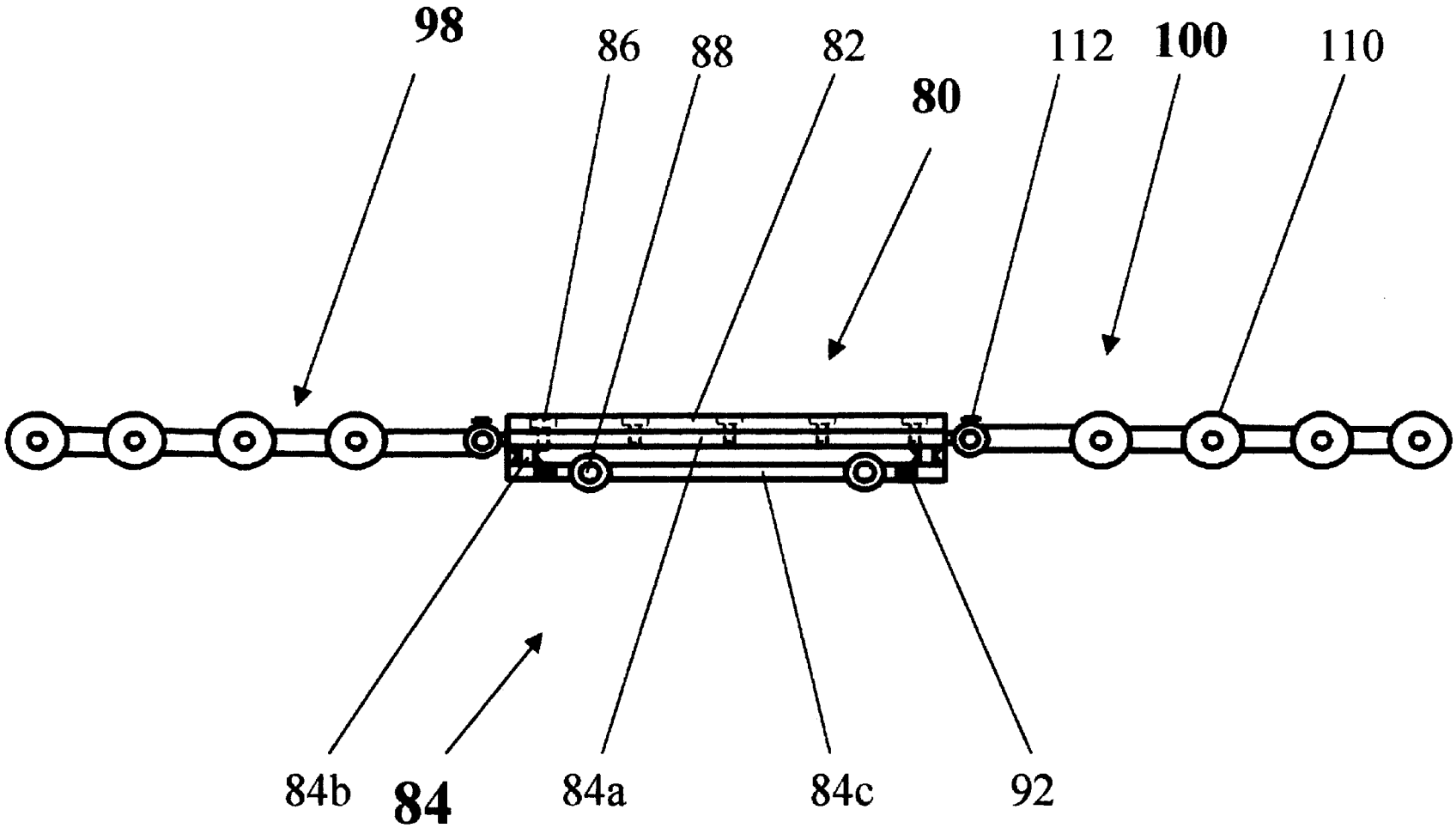
FIG. 9 is a side view of the mobile carriage 80 depicted in FIG. 8.

The third major embodiment is the "Mobile Carriage" 80 (as viewed in FIGS. 8, 9 & 13) As illustrated in FIGS. 8 and 9 the mobile carriage 80 includes a flat padded platform 82, and two identical padded back support extensions 98 and 100 connected to each end of the undercarriage frame 84.

The undercarriage frame 84 is composed of a pair of top support beams 84*a,* a pair of end support beams 84*b* and a pair of bottom support beams 84*c* interconnected by welding.

Figure 13:
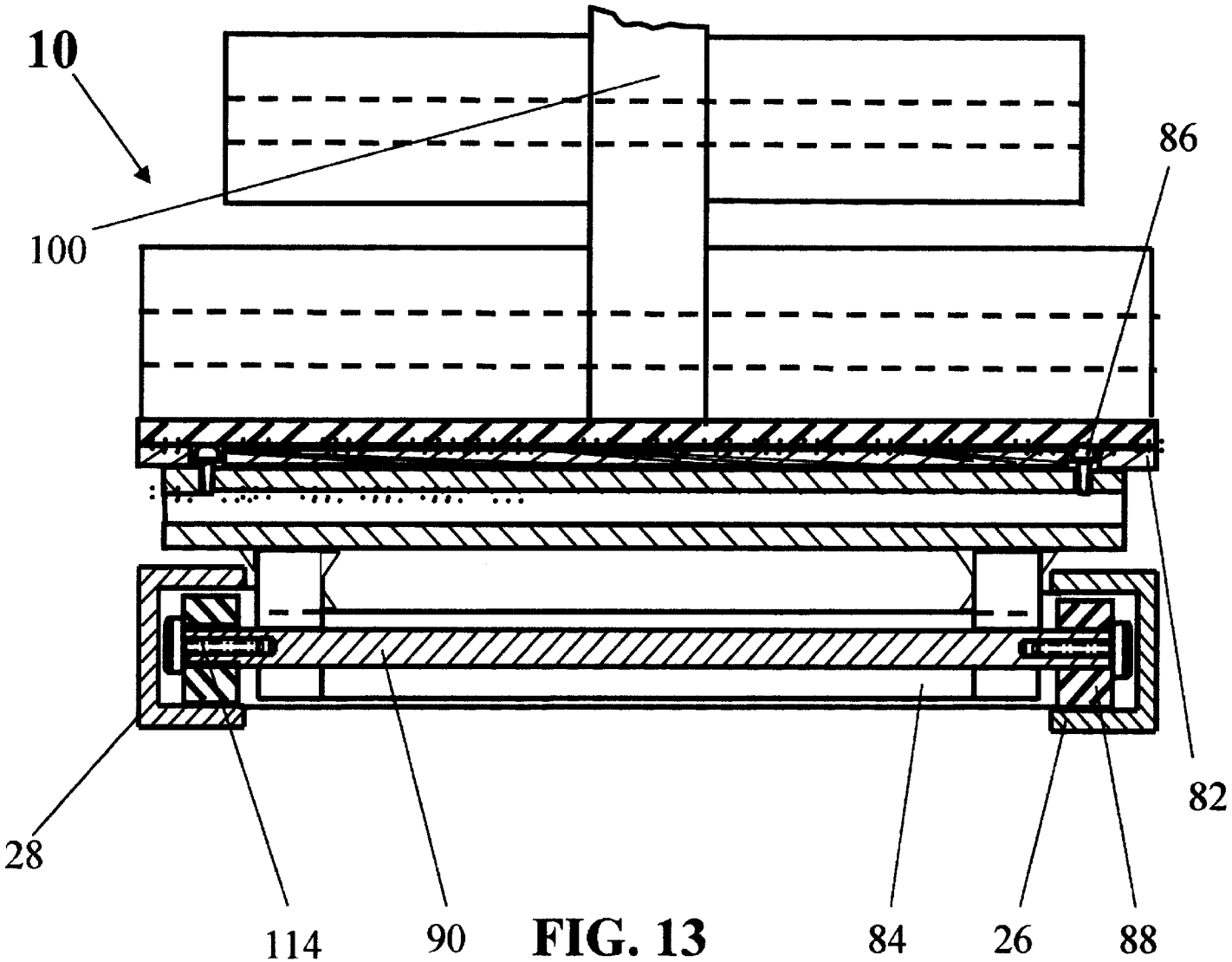
FIG. 13 is a sectional view "H—H" of the apparatus 10 depicted in FIG. 2.

The undercarriage frame 84 is made from structural grade aluminum and the flat padded platform 82 is preferably constructed of hard plywood connected to the undercarriage frame 84 by a set of detachable fasteners 86 (as viewed in FIG. 13). The padding on the platform 82 is fabricated of high density foam.

The mobile carriage 80 further includes a set of wheels 88 mounted by axles 90 and detachable fasteners 114 to the undercarriage frame 84, adjacent the left and right ends of each of the side support beams.

The mobile carriage 80 rolls on rails 26 and 28 which have a U shape profile and thereby providing more safety, smooth and accurate rolling motion of the rollers 88. The mobile carriage 80 uses a set of rollers 92 as guides mounted in a horizontal position and are used to eliminate the usual wheel to side scuffing associated with the traditional prior art bench. The set of rollers 92 are connected to the undercarriage frame 84 by set of detachable fasteners 94.

Figure 10:
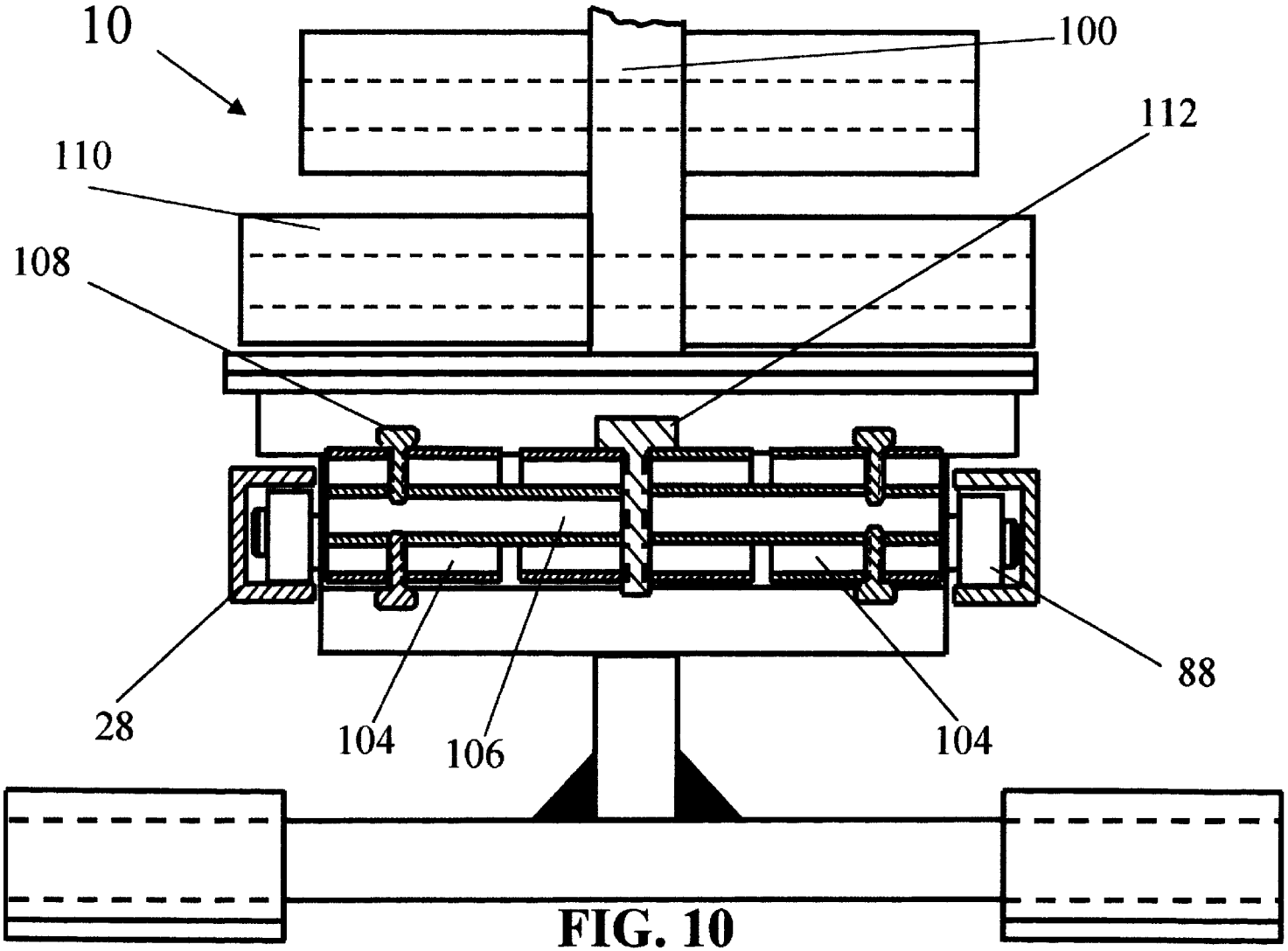
FIG. 10 is a sectional view "A—A" of the apparatus 10 depicted in FIG. 2.
Figure 14:
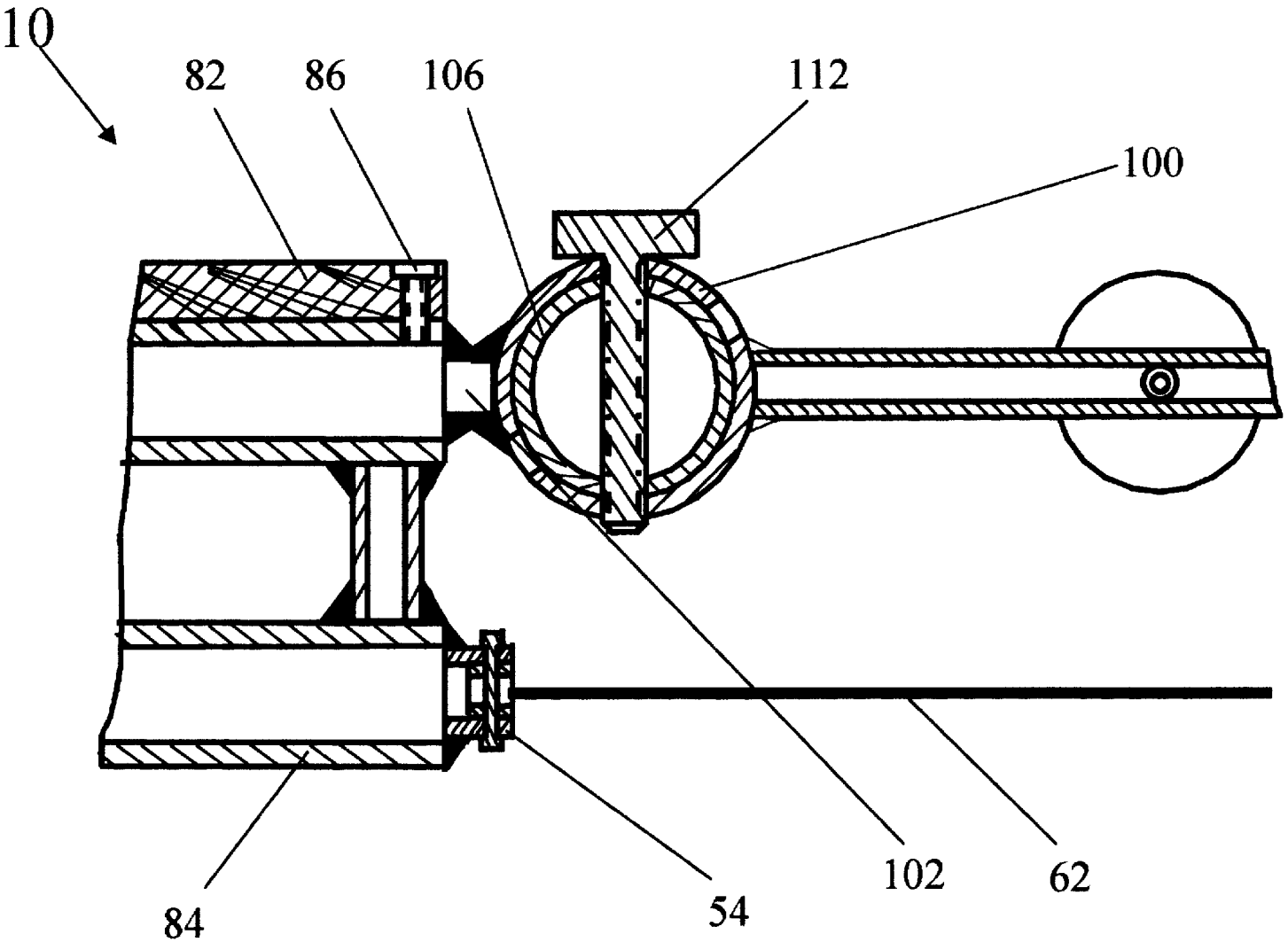
FIG. 14 is a sectional view "G—G" of the apparatus depicted in FIG. 8.

The wheels 88 and the guide rollers 92 are mold-on thermo cushion rubber wheels. At each end of the undercarriage frame 84, there are two spacers 102 and two sleeves 104 interconnected by welding to the undercarriage frame 84. Further the sleeves 104 are connected to the two identical and adjustable padded back rest 98 and 100 by axle 106 and by sets of detachable fasteners 108 (as viewed in FIGS. 10 & 14).

The back rest 98 and 100 are padded with sets of foam sleeves 110 fabricated from high density foam.

The back rest 98 includes a round tubular sleeve 98*a,* round tubular extension 98*b,* and four round tubular supports 98*c,* 98*d,*98*e* and 98*f* interconnected by welding. The back rest 100 includes a round tubular sleeve 100*a,* round tubular extension 100*b,* and four round tubular supports 100*c,* 100*d,*100*e* and 100*f* interconnected by welding.

Figure 17:
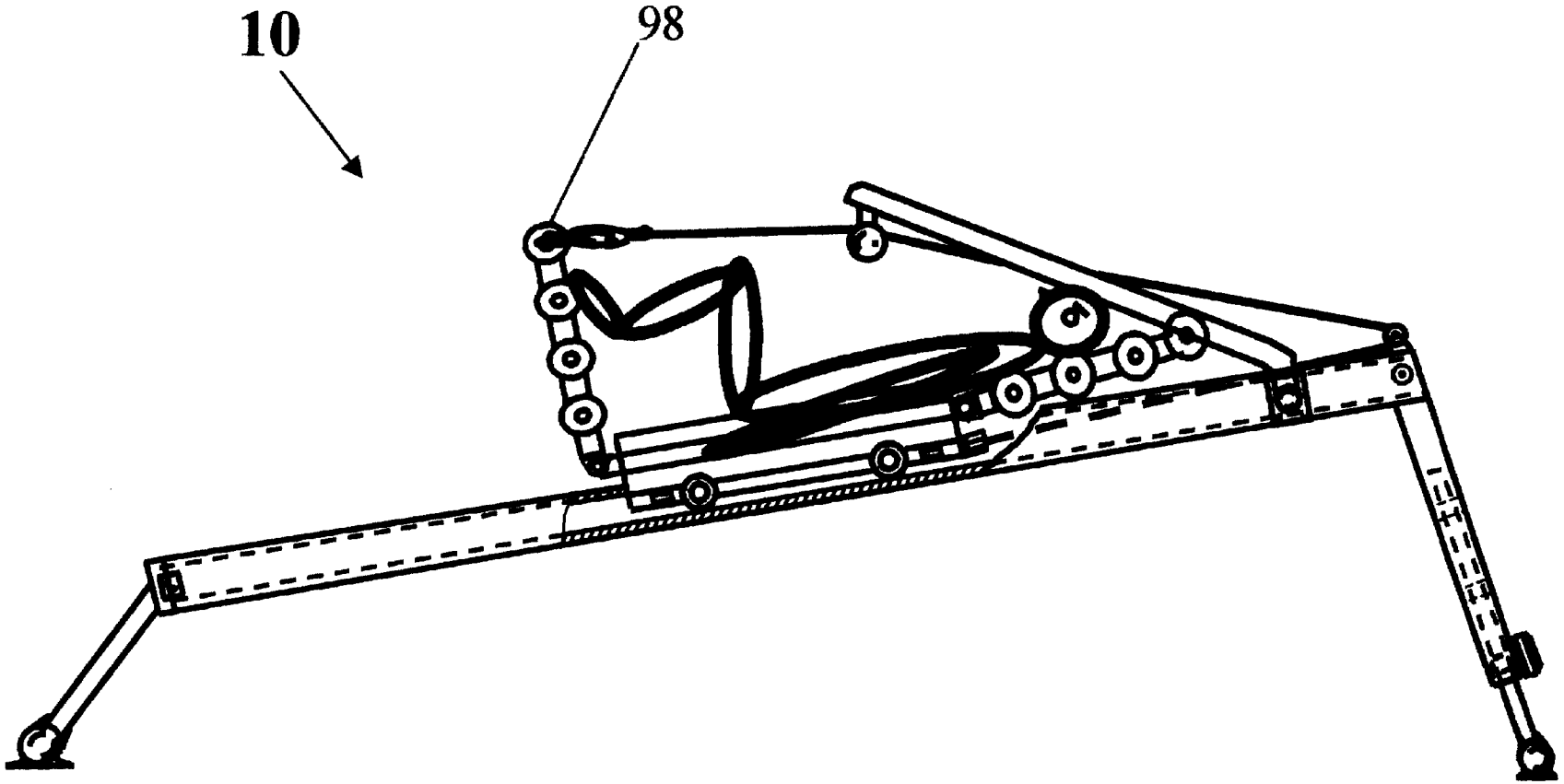
FIG. 17 is a side view of an embodiment of the apparatus 10 of the present invention viewing the back rest 98 used for legs conditioning.
Figure 18A:
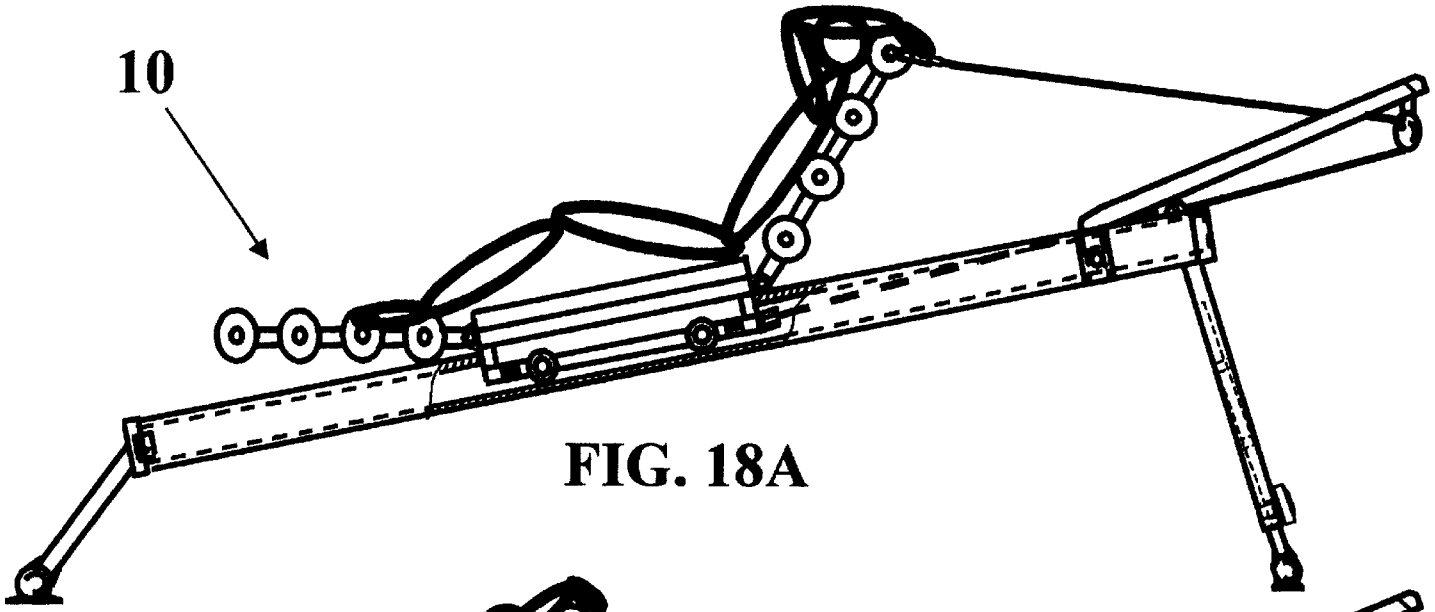
FIGS. 18A and 18B are a side view of an embodiment of the apparatus 10 of the present invention viewing the back rest 100 used for abdominal muscle conditioning.
Figure 18B:
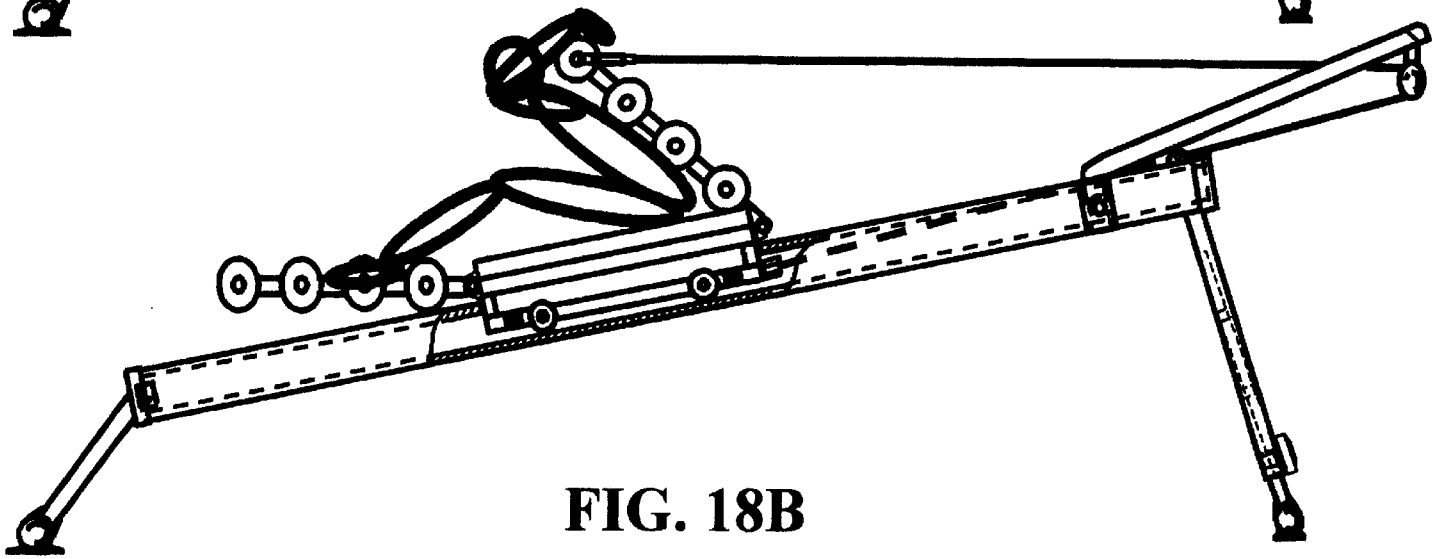
Figure 19:
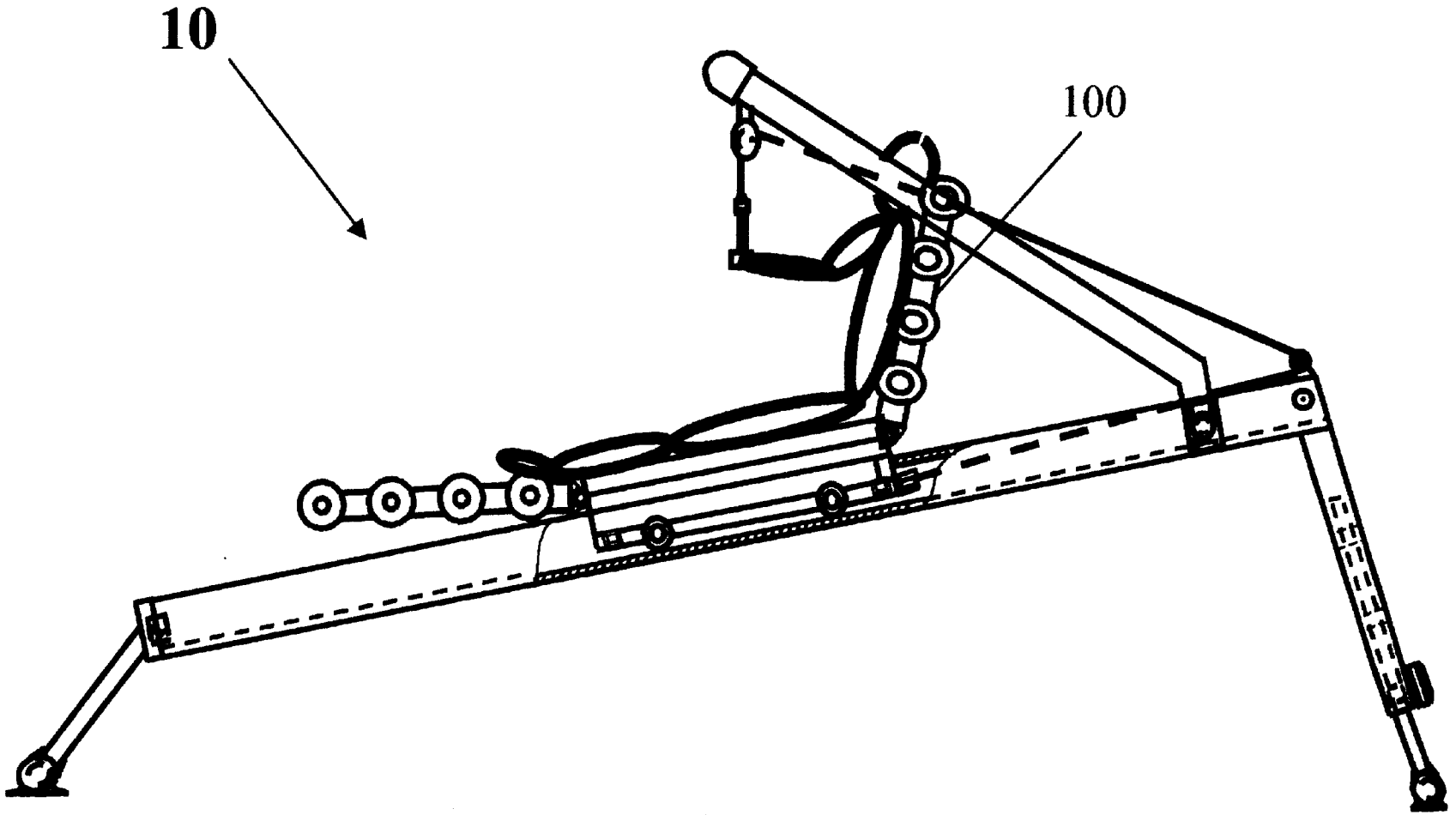
FIG. 19 is a side view of an embodiment of the apparatus 10 of the present invention viewing the posts 52 rotated 90 degrees for pectoral muscle conditioning.

The back rest 98 it is also used as a legs device (as viewed in FIG. 17) and the back rest 100 can be used for abdominal muscles conditioning, (as viewed in FIG. 18).

When used as legs device and for abdominal muscles conditioning the back rest 98 and 100 are connected to the cord hooks 64. The back rest 98 and 100 can rotate freely and can be locked in a vertical or horizontal position by a detachable threaded knob 112, (as viewed in FIG. 16). The back rest 98 and 100 is made from structural grade aluminum. Thus, pulling of handles 68 by the user's hands or feet will tend to move the mobile carriage 80 against the resistance force produced by the user's body weight and the frame's incline slope.

What is claimed is:

1. An exercise apparatus comprising:

an elongate main frame;

a carriage assembly moveably mounted to said elongate main frame;

means for guiding said carriage assembly to roll along a length of said elongate main frame;

said carriage assembly further comprising a platform for supporting a user, a first support extension pivotally mounted to a first end of said platform, and a second support extension pivotally mounted to a second end of said platform;

means for selectively pivoting said first support extension so that said first support extension is freely pivoting with respect to the platform for use as an abdominal muscle exercise station or said first support extension is locked with respect to the platform for use as a backrest;

means for selectively pivoting said second support extension so that said second support extension is freely pivoting with respect to the platform for use as a leg muscle exercise station or said second support extension is locked with respect to the platform for use as a backrest; and a cord assembly connecting said carriage assembly and said main frame, wherein engagement of the cord assembly by a user supported on the carriage assembly moves the carriage assembly along the length of the elongate main frame against resistance of the user's body weight.

2. The exercise apparatus of claim 1 wherein the first support extension comprises a distal end including means for connecting to said pulley assembly so that pivoting of the first support extension relative to the carriage assembly causes said carriage assembly to move along the length of said elongate main frame, wherein the user supported upon the carriage assembly pivots the first support extension to exercise their abdominal muscles.

3. The exercise apparatus of claim 1 wherein the second support extension comprises a distal end including means for connecting to said pulley assembly so that pivoting of the second support extension relative to the carriage assembly causes said carriage assembly to move along the length of said elongate main frame, wherein the user supported upon the carriage assembly pivots the second support extension to exercise their leg muscles.

4. The exercise apparatus of claim 1 wherein said cord assembly comprises a pair of handles for engagement by the user supported upon the carriage assembly.

5. The exercise apparatus of claim 1 wherein said elongate main frame comprises a leg supporting an end of the elongate main frame;

said leg including means for adjusting its length so that the angle of inclination of the elongate main frame relative to a supporting surface is selectively adjustable.

6. The exercise apparatus of claim 1 further comprising a first and a second post pivotally mounted and selectively pivotally locked to an end of said elongate main frame;

each said post comprising a pulley mounted to a distal end of the post opposite from its connection to the elongate main frame;

said cord assembly comprising a cord entrained over each of said pulleys and connected to said carriage assembly, wherein the pivotal orientation of each post relative to the elongate main frame may be selected by the user to determine exercises to be performed.

7. The exercise apparatus of claim 1 further comprising means for selectively adjusting an angle of inclination of the elongate main frame with respect to a surface supporting the elongate main frame.

8. An exercise apparatus comprising:

an elongate main frame;

a carriage assembly moveably mounted to said elongate main frame;

means for guiding said carriage assembly to roll along a length of said elongate main frame;

said carriage assembly further comprising a platform for supporting a user, a first support extension pivotally mounted to a first end of said platform, and a second support extension pivotally mounted to a second end of said platform;

a first and a second post pivotally mounted and selectively pivotally locked to an end of said elongate main frame;

each said post comprising a pulley mounted to a distal end of the post opposite from its connection to the elongate main frame;

a cord assembly connecting said carriage assembly and said main frame;

said cord assembly comprising a cord entrained over each of said pulleys and connected to said carriage assembly, wherein engagement of the cord assembly by a user supported on the carriage assembly moves the carriage assembly along the length of the elongate main frame against resistance of the user's body weight and the pivotal orientation of each post relative to the elongate main frame is selected by the user to determine exercises to be performed.

9. The exercise apparatus of claim 8 wherein the first support extension comprises a distal end including means for connecting to said pulley assembly so that pivoting of the first support extension relative to the carriage assembly causes said carriage assembly to move along the length of said elongate main frame, wherein the user supported upon the carriage assembly pivots the first support extension to exercise their abdominal muscles.

10. The exercise apparatus of claim 8 wherein the second support extension comprises a distal end including means for connecting to said pulley assembly so that pivoting of the second support extension relative to the carriage assembly causes said carriage assembly to move along the length of said elongate main frame, wherein the user supported upon the carriage assembly pivots the second support extension to exercise their leg muscles.

11. The exercise apparatus of claim 8 wherein said cord assembly comprises a pair of handles for engagement by the user supported upon the carriage assembly.

12. The exercise apparatus of claim 8 further comprising a leg supporting said end of said elongate main frame;

said leg including means for adjusting its length so that the angle of inclination of the elongate main frame relative to a surface supporting the elongate main frame is selectively adjustable.

13. The exercise apparatus of claim 8 further comprising means for selectively adjusting an angle of inclination of the elongate main frame with respect to a surface supporting the elongate main frame.

* * * * *